United States Patent [19]

Nagasawa

[11] 3,958,408

[45] May 25, 1976

[54] CIRCUIT BLOCK FOR AN ELECTRONIC WATCH

[75] Inventor: Kazuo Nagasawa, Tokyo, Japan

[73] Assignee: Kabushiki Kaisha Daini Seikosha, Japan

[22] Filed: Nov. 14, 1974

[21] Appl. No.: 523,892

[30] Foreign Application Priority Data

Nov. 17, 1973 Japan ..... 48-132952[U]

[52] U.S. Cl. ..... 58/23 AC; 58/55

[51] Int. Cl.[2] ..... G04C 3/00; G04B 27/00

[58] Field of Search ..... 58/23 R, 23 AC, 55; 331/177 R

[56] References Cited

UNITED STATES PATENTS 3,759,031 9/1973 McCullough ..... 58/50 R 3,800,523 4/1974 Yamazaki ..... 58/23 R

*Primary Examiner*—Edith Simmons Jackmon

*Attorney, Agent, or Firm*—Robert E. Burns; Emmanuel J. Lobato; Bruce L. Adams

[57] ABSTRACT

A circuit block for an electronic watch comprises a time standard circuit, that is a timing module and a regulating element. The time standard circuit unit includes an oscillator, an oscillating circuit, a divider and a driving circuit all of which are collectively sealed in a vacuum or evacuated case. The regulating element serves to regulate the period of output signals from the time standard circuit unit at a value to be required. The time standard circuit unit and the regulating element are mounted on the same substrate.

4 Claims, 4 Drawing Figures

CIRCUIT BLOCK FOR AN ELECTRONIC WATCH

BACKGROUND OF THE INVENTION

This invention relates to a construction of a circuit block for an electronic watch.

A conventional electronic watch, for example, a quartz crystal watch has one or a plurality of circuit blocks comprising an oscillator acting as a time standard, an oscillating circuit for driving the oscillator, a divider for dividing signals from the oscillating circuit into a signal to be required and a driving circuit for driving a wheel train or a time display each of which has been separately or partially mounted and which has been electrically connected by a screw, soldering or welding. Nowadays, this has not much merit because techniques for making electronic circuits have been improved, though it has had a merit in that a service of the unit in case of the development of troubles has been small.

Another disadvantage remains in that a mounting and an assembling take much time: costs increases: a large space is required: and reliability is decreased because of the many connecting points.

SUMMARY OF THE INVENTION

An object of the present invention is to provide a circuit block for an electronic watch including a small number of circuit units.

Another object of the present invention is to provide a circuit block for an electronic watch having a high reliability.

According to the present invention, main parts of a circuitry which are collectively vacuum-sealed serve as a timing unit. The timing unit and a regulating element serving as a regulating function are mounted on the same substrate (or in a same circuit case). Connections between units in the circuit block and the connections between the circuit block and the exterior are so decreased that the assembling of a watch may be rationalized.

In the circuit block according to the present invention, connecting terminals to the exterior include only four terminals, that is at least two output terminals, a plus source terminal and a minus source terminal. Besides, an additional function may be supplied with a reset terminal and a signal terminal for an additional mechanism in accordance with each aim of the various watches.

DESCRIPTION OF THE PREFERRED EMBODIMENTS

The present invention will be fully described by way of the embodiment in connection with the accompanying drawings.

Figure 1:
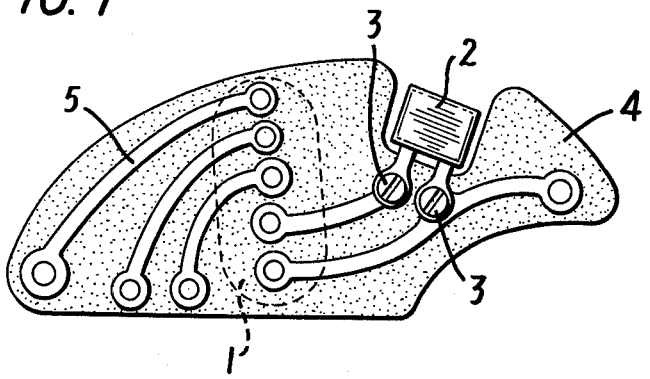
FIG. 1 is a plan view showing a first embodiment of a circuit block according to the present invention.
Figure 2:
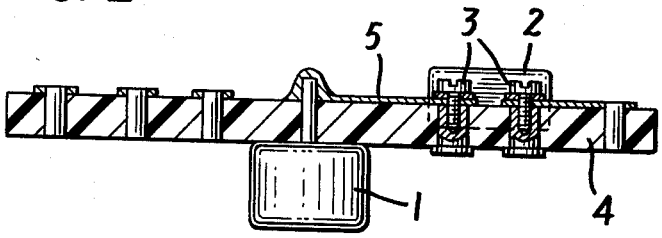
FIG. 2 is a side elevation view showing the development of the circuit block shown in FIG. 1.

Referring to FIGS. 1 and 2, there is shown a circuit block according to the present invention wherein a time standard circuit unit having an evacuated case 1 is mounted on a printed substrate 4. A chip condenser 2 the capacity of which is selected at a suitable value is interchangeably mounted on the same printed substrate 4 by mean of a screws 3. Copper foil conductors 5, which are formed on the printed substrate 4 by a photo-etching, serve to connect each terminal of the elements. The time standard circuit unit 1 is connected with the pattern of the printed substrate 4 by soldering, etc.

Figure 3:
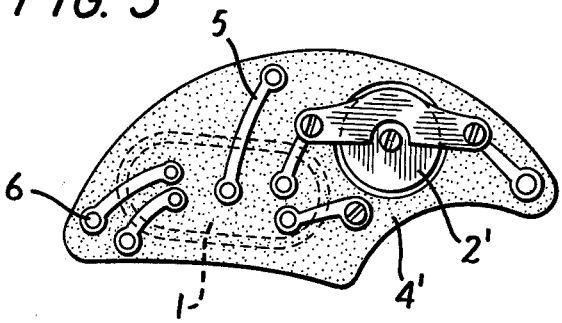
FIG. 3 is a plan view of a second embodiment of the circuit block according to the present invention.
Figure 4:
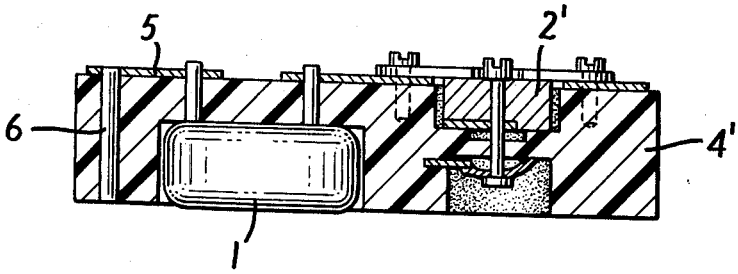
FIG. 4 is a side elevation view showing the development of the circuit block shown in FIG. 3.

Referring to FIGS. 3 and 4, there is shown another embodiment of the circuit block according to the present invention. A circuit case 4' is formed as the substrate by an injection mold, etc. The terminal of each element is connected with the circuit case 4' by means of the electrodes or conductors 5. It is to be noted that conductors 5 are formed by a rapping etc. in this embodiment. A terminal 6 is connected with a conductor 5 by soldering, a welding a caulking or etc. A trimmer condenser 2' is directly mounted on the circuit case 4' and the time standard circuit unit 1 is also mounted in the circuit case 4'.

As mentioned above, a circuit block according to the present invention brings about many advantages as follows: since electronic circuit elements which are collectively vacuum-sealed and regulating elements for regulating a time accuracy are mounted in the same substrate, the life of the circuit function and the reliability therefor are increased; since the number of connecting points in the circuit block is greatly decreased, the quality and the reliability thereof is raised; and since the construction of the circuit block is simplified, assembling is rationalized.

What is claimed is:

1. A circuit block for an electronic watch comprising; a printed circuit substrate; a timing module secured to said substrate comprising a time standard circuit having an oscillator, an oscillating circuit, a divider and a driving circuit; a regulating element interchangeably mounted on said substrate for regulating the period of the output signals from said timing module to a desired frequency, said regulating element comprising a capacitor having a capacity effective to regulate the period of said output signals to the desired frequency, an evacuated case containing said time standard circuit, and conductors on said printed circuit substrate connecting said regulating element to said timing module and including output conductors from said timing module.

2. A circuit block according to claim 1, in which said capacitor is a chip capacitor.

3. A circuit block according to claim 1, in which said capacitor is a trimmer capacitor.

4. A circuit block according to claim 1, in which said timing module and said regulating element are disposed within said substrate.

* * * * *